US006669493B2

(12) United States Patent
Kuroda

(10) Patent No.: US 6,669,493 B2
(45) Date of Patent: Dec. 30, 2003

(54) CARD CONNECTOR UNIT PROVIDED WITH FIRST ACCOMODATING POSITION AND SECOND ACCOMODATING POSITION

(75) Inventor: Yoshimasa Kuroda, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 15 days.

(21) Appl. No.: 10/081,566

(22) Filed: Feb. 20, 2002

(65) Prior Publication Data

US 2002/0137378 A1 Sep. 26, 2002

(30) Foreign Application Priority Data

Mar. 26, 2001 (JP) ..... 2001-088283

(51) Int. Cl.[7] ..... H01R 13/62; H01R 24/00
(52) U.S. Cl. ..... 439/159; 439/157; 439/630
(58) Field of Search ..... 439/159, 160, 439/155, 157, 630; 235/441, 492

(56) References Cited

U.S. PATENT DOCUMENTS 5,984,702 A * 11/1999 Nishioka ..... 439/159
6,059,589 A * 5/2000 Nishioka ..... 439/159
6,113,403 A * 9/2000 Oguchi ..... 439/159
6,174,192 B1 * 1/2001 Watanabe et al. ..... 439/377
2002/0132527 A1 * 9/2002 Ito et al. ..... 439/630

FOREIGN PATENT DOCUMENTS

JP 2000-251025 9/2000

* cited by examiner

*Primary Examiner*—Chandrika Prasad
(74) *Attorney, Agent, or Firm*—Beyer Weaver & Thomas, LLP.

(57) ABSTRACT

An SD card is enabled to be selectively placed in a first accommodating position of a smaller insertion depth and a second accommodating position of a greater insertion depth, and there is also provided a shifting mechanism for shifting the SD card in a discharging direction. This makes it possible, for instance, to insert a longer SD card deep inward and stow it in the second accommodating position when the unit is to be carried by the user, and to bring the SD card more outward with the shifting mechanism and to place it in the first accommodating position when the antenna circuit or the like is to be used, resulting in enhanced convenience for use. If the shifting mechanism is provided with sliding members, a heart-shaped cam groove, engaging pins, energizing members and the like, the longer SD card can be easily and smoothly shifted from one accommodating position to the other.

6 Claims, 18 Drawing Sheets

(HEIGHTS OF DIFFERENT PARTS)

CARD CONNECTOR UNIT PROVIDED WITH FIRST ACCOMODATING POSITION AND SECOND ACCOMODATING POSITION

BACKGROUND OF THE INVENTION

1. Field of the Invention

The present invention relates to a card connector unit for accommodating a small memory card or what is known as an SD card and connecting a group of external connection terminals provided on this card to an electronic circuit provided in an electronic device such as a personal computer (PC), and more particularly to a card connector unit compatible with cards extended in length to be adaptable to multiple functions.

2. Description of the Related Art

Cards that can be freely inserted or withdrawn from an electronic device such as a PC or an electronic camera and permits writing or reading of information (hereinafter known as SD cards) are already known according to the prior art. This kind of card is substantially rectangularly shaped, and at one end of one side are arrayed a plurality of external connection terminals. The electronic device to accommodate such SD cards is provided with a circuit board on which are mounted required electronic circuits and a card connector unit for connecting the group of external connection terminals mounted on the SD card to the electronic circuits.

Such a card connector unit is provided with a housing having an accommodating space into which the SD card is to be inserted through an inlet, a plurality of terminal pieces fixed to this housing and exposed in the accommodating space, and a discharging mechanism for discharging an accommodated SD card.

The housing is usually configured by combining a frame made of an insulating material and a cover made of a metallic material or an insulating material, and an SD card accommodating space is formed between the frame and the cover. Each terminal piece is provided with a contact exposed within the accommodating space to be able to come into contact with the connection terminals of an SD card and a soldering portion to be soldered onto an electronic circuit provided in an electronic apparatus such as a personal computer (PC). It is so designed that, when an SD card inserted into the accommodating space is placed in a prescribed position, the group of its external connection terminals come into contact with the contact of each terminal piece.

A discharging mechanism of a known configuration, for instance, comprises a slider capable of reciprocating in engagement with an SD card, coil springs elastically energizing this slider in the direction of discharging the card, and engaging pins guided along a heart-shaped cam groove. When the operator presses with fingers the SD card placed in a prescribed position, on the edge toward him or her (rear edge), this configuration, by causing the slider and the engaging pin to work in conjunction, enables the card to move together with the slider outward to the operator's side to be readily discharged. Another known configuration is such that, by operating a member for discharging action to release the SD card engaged in a prescribed position, the card can be discharged.

Incidentally, in connection with a recently rising call for the usability of an SD card not only as a mere recording medium but also as a communication device by providing it with a transmitter/receiver circuit or the like, the emergence of a new type SD card extended in length but the same in terminal specification as the conventional SD card is expected. A well conceivable use of such a new type SD card is, for instance, to arrange an antenna circuit for short range radio communication toward the rear end of an SD card of an extended length, keep the SD card in only a shallowly inserted position in the connector unit only when this antenna circuit is to be used, and insert the SD card deep into the connector unit when the antenna is not to be used.

However, since the conventional card connector unit does not have a structure to accommodate such a long SD card, it may allow the SD card to be inserted to a prescribed extent and electrically connected, but, for instance when the antenna circuit is not to be used, it is impossible to insert the SD card deeply and keep it there. Thus, if a card connector unit for a conventional card is to be adapted to a longer-than-usual SD card, the SD card will have to kept substantially protruding outward from the inlet of the accommodating space of the housing, not only will the appearance be awkward but also it will result in serious inconvenience of use because the electronic apparatus such as a laptop PC will have to be carried with the SD card kept inserted in the connector unit.

SUMMARY OF THE INVENTION

The present invention has been attempted to obviate these disadvantages of the prior art, and to provide a more convenient card connector unit allowing selective placement of an SD card of an extended length in any of positions differing in insertion depth.

In order to achieve the object noted above, a card connector unit according to the invention has a configuration comprising a housing having an accommodating space into which a card provided with a group of external connection terminals (SD card) is inserted from a side of an inlet and permitting the card to be selectively placed within the accommodating space in a first accommodating position in which an insertion depth is smaller or a second accommodating position in which an insertion depth is greater; terminal sections fixed to the housing to be exposed in the accommodating space and being in contact with the group of external connection terminals at least when the card is in the first accommodating position; and a shifting mechanism for driving the card inserted in the accommodating space to be shifted at least from the second accommodating position to the first accommodating position.

Since a connector unit of such a configuration not only allows a shorter SD card to be inserted and placed in the first accommodating position but also a longer SD card to be placed either in the first accommodating position or the second accommodating position, if the longer SD card is placed in the first accommodating position, for instance an antenna circuit built into that SD card can be exposed to enable it to be used as a communication device. Or if the longer SD card is inserted deep into the second accommodating position, it can be used as a recording medium or stowed in a state convenient for carrying. If the longer SD card placed in the first accommodating position is pressed by the operator deeper inward with fingers, the SD card can be easily shifted to the second accommodating position, and the longer SD card placed in the second accommodating position can be shifted to the first accommodating position using the shifting mechanism. Thus the longer SD card can be easily shifted from one accommodating position to the other.

Further in the above-described configuration according to the invention, the shifting mechanism may be provided with sliding members capable of reciprocating along an inserting/discharging direction of the card while being kept engaged with the card, engaging pins shifting along a heart-shaped cam groove along with shifting of the sliding members, and energizing members for elastically energizing the sliding members in a discharging direction of the card. If it is so arranged that, when the card is placed in the second accommodating position, the engaging pins may be engaged with pin engaging portions of the heart-shaped cam groove to inhibit shifting of the sliding members and, by pressing the card deeper in the accommodating space in such a state and thereby disengaging the engaging pins from the pin engaging portions, the card can be shifted in the discharging direction from the second accommodating position via the sliding members, the operator can press the SD card placed in the first accommodating position further inward to a prescribed extent to engage the engaging pins with the pin engaging portions of the heart-shaped cam groove to bring to halt the SD card in the second accommodating position. Or the operator can press the SD card placed in the second accommodating position to disengage the engaging pins from the pin engaging portions to direct the SD card to the first accommodating position with the elastic force of the energizing members. Therefore the longer SD card can be easily shifted from one accommodating position to the other.

If, in addition to this configuration, there is provided a discharging mechanism capable of discharging the card placed in the first accommodating position, when the SD card placed in the second accommodating position is to be discharged, there will be no need to rely only on the elasticity of the energizing members of the shifting mechanism and, if the energizing members are coil springs, the extent of their extension and contraction can be restrained to elongate their service lives. Nor will there be the phenomenon of an increase in reaction force with the elongation of the insertion depth of the SD card, resulting in improved operating ease.

In this case, the configuration may as well be such that the discharging mechanism is provided with a first sliding member capable of reciprocating along the inserting/discharging direction of the SD card; an engaging arm rotatably pivoted on this first sliding member and permitting engagement with the fore edge of the SD card; a first engaging pin shifting along a prescribed guide groove along with the shifting of the first sliding member, and a first energizing member for elastically energizing the first sliding member in the card discharging direction; and there may be further provided a rotation regulator for regulating outward rotation of the engaging arm when an inserted position of the card has not reached the first accommodating position, and a rotation permitting section for permitting outward rotation of the engaging arm and setting aside the engaging arm on the way of shifting of the card from the first accommodating position to the second accommodating position. Then, as the engaging arm steps aside into the rotation permitting section at a stage where the SD card is inserted midway between the first accommodating position and the second accommodating position, there is no need to set back the first sliding member any further, and the SD card can be pressed further inward while moving back the sliding members of the sliding member to bring it to the second accommodating position. Therefore, if the first energizing member is a coil spring for instance, the extent of its extension and contraction can be restrained to elongate its service life.

Or the guide groove of the discharging mechanism may as well be provided with a return path for guiding the first engaging pin in a process of shifting the SD card from the second accommodating position to the first accommodating position, a return pin engaging portion capable of holding the SD card in the first accommodating position by engaging the first engaging pin having passed the return path, and a proceeding path extending inward from the return pin engaging portion to enable the SD card to shift from the first accommodating position to the second accommodating position. Then, by engaging the first engaging pin with the return pin engaging portion, the first sliding member can be inhibited from shifting and the SD card can be held in the first accommodating position. Then, if the SD card is pressed further inward from the first accommodating position, the first engaging pin will be disengaged from the return pin engaging portion and shift further inward on the proceeding path, or if, conversely, the SD card is pressed outward from the second accommodating position outward by the shifting mechanism, the first engaging pin will shift outward to be engaged with the return pin engaging portion. Therefore, without having to using a complex configuration, the SD card can be easily and smoothly shifted between the first accommodating position and the second accommodating position.

To add, where the SD card placed in the first accommodating position is to be discharged with an operating member, the guide groove may be provided with a discharging path for guiding the first engaging pin in a process of shifting the card outward from the first accommodating position and an operating member for discharging the card placed in the first accommodating position, and the first engaging pin can be shifted from the return pin engaging portion to the discharging path by manipulating the operating member to press in the first engaging pin. Then the discharging can be simplified and made reliable without requiring a complex configuration.

DESCRIPTION OF THE PREFERRED EMBODIMENTS

Figure 1:
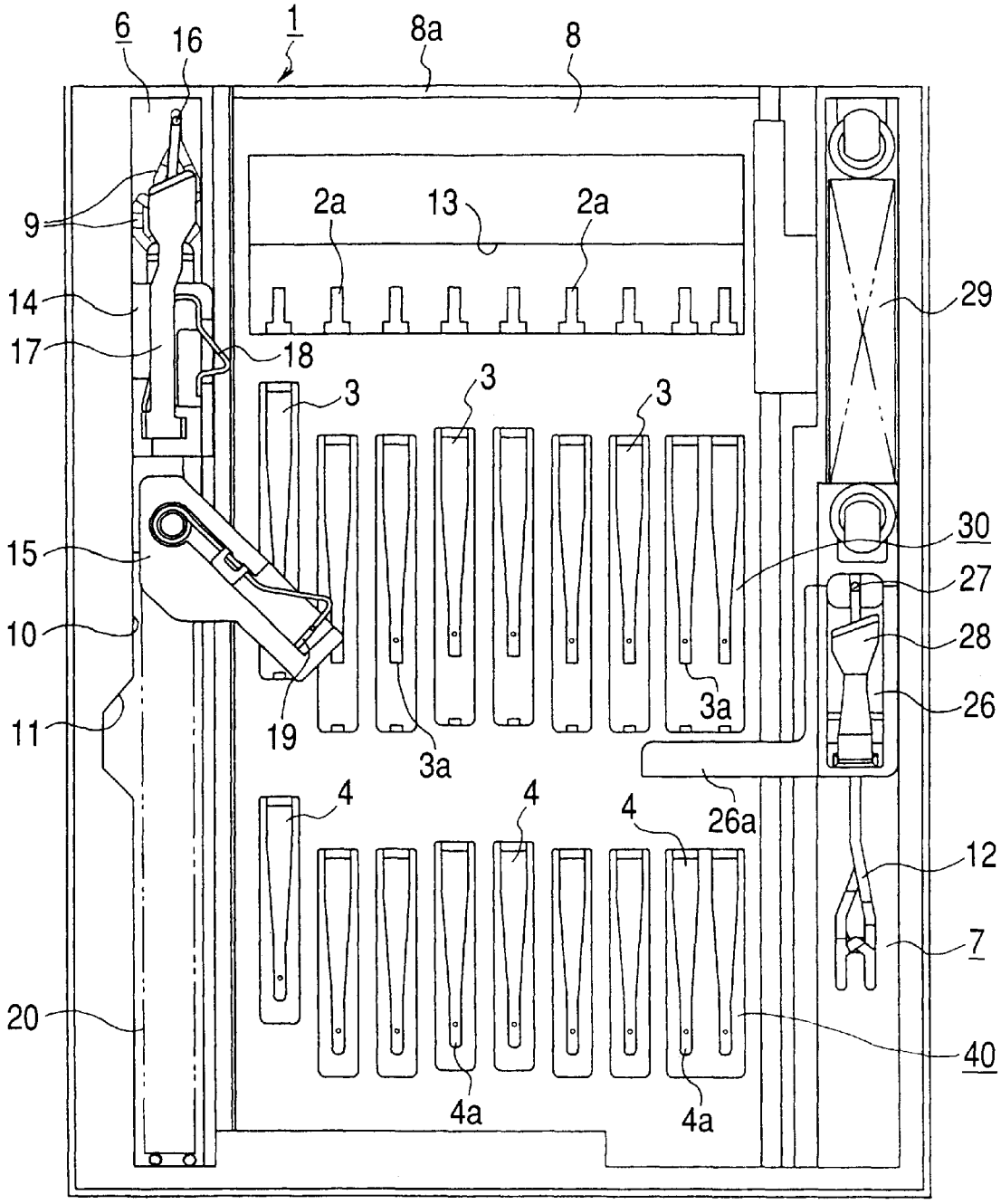
FIG. 1 shows a plan of a card connector unit in a mode of carrying out the present invention.
Figure 2:
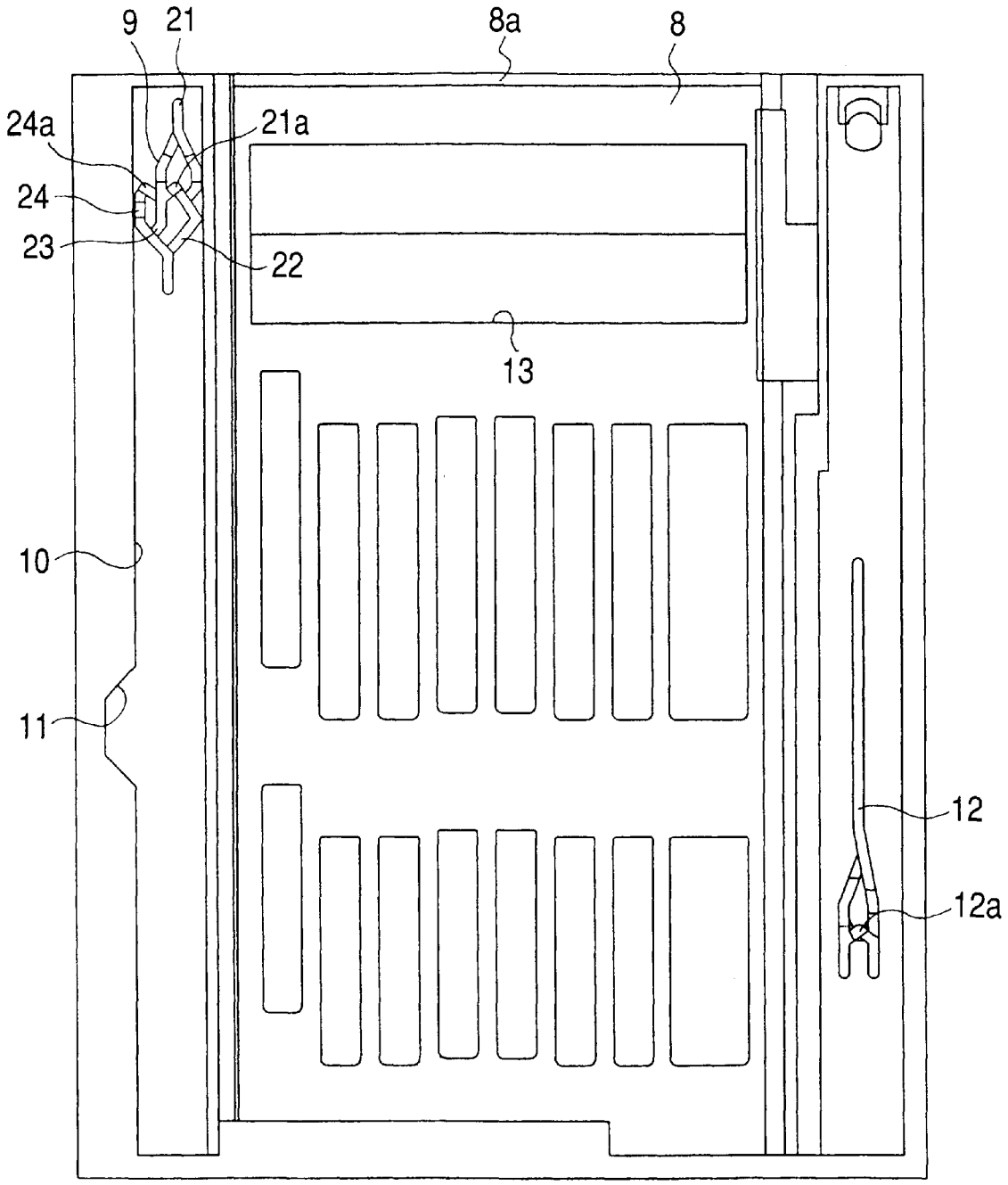
FIG. 2 shows a plan of the housing of the card connector unit.
Figure 3:
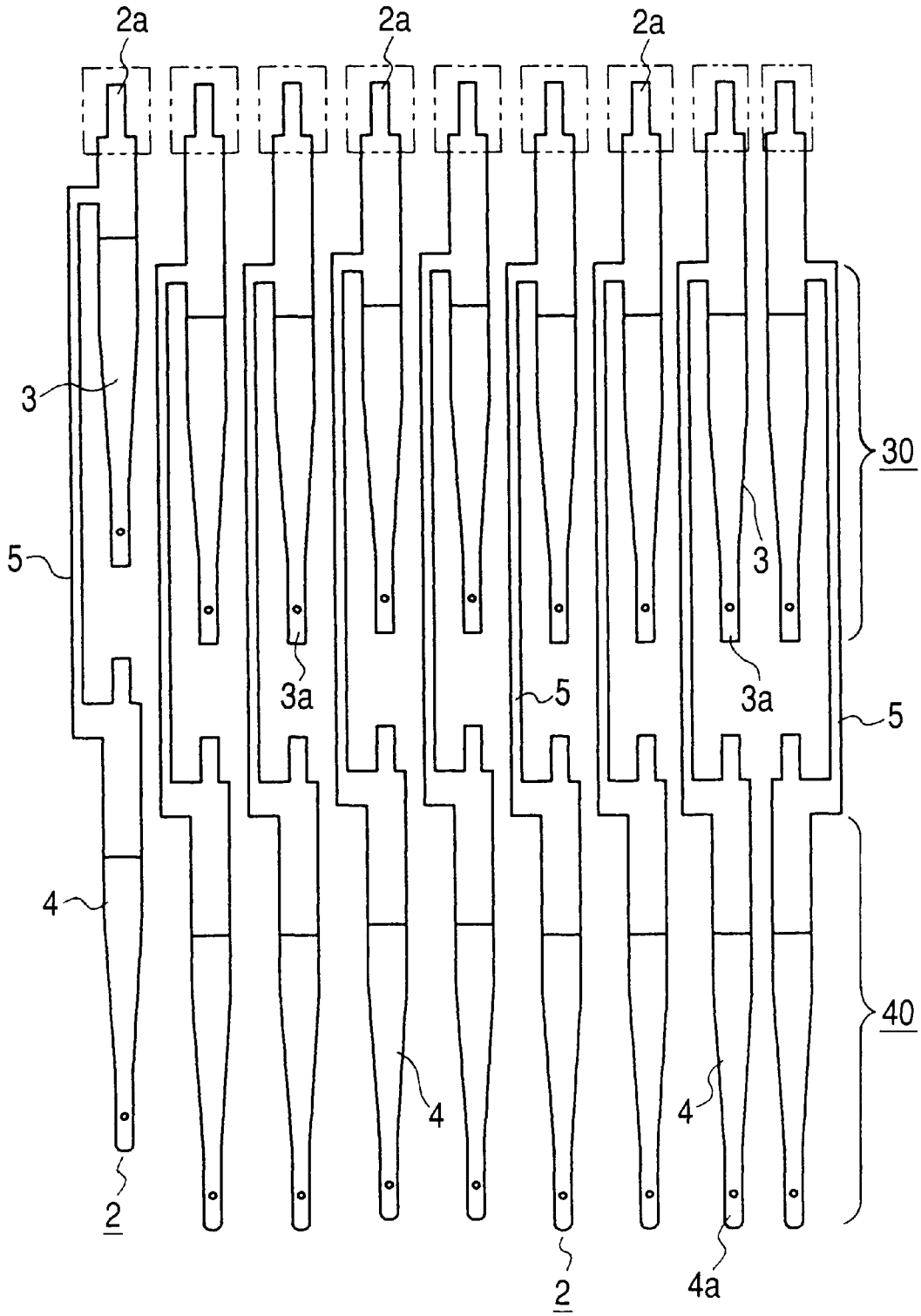
FIG. 3 shows a plan of the terminal section of the card connector unit.
Figure 4:
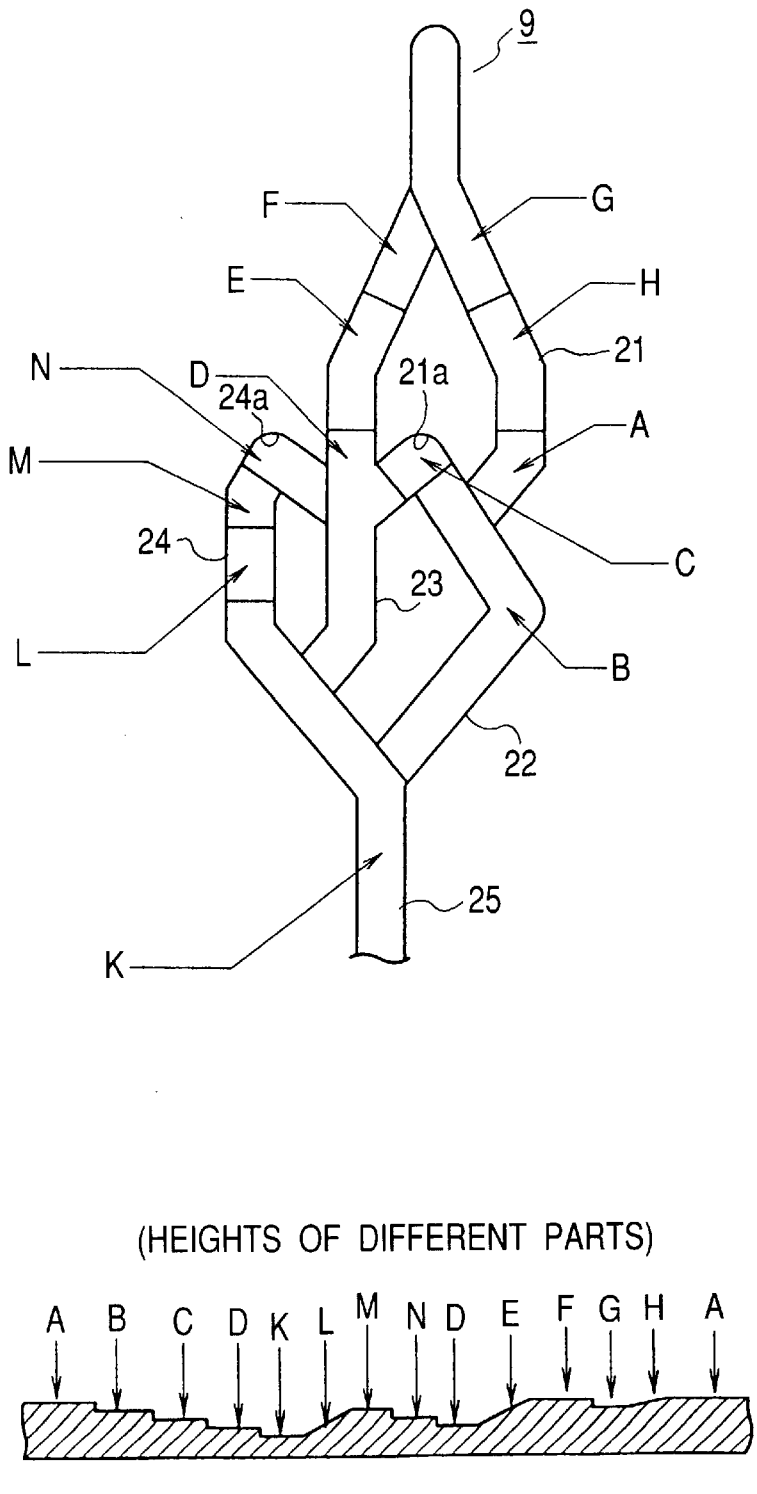
FIG. 4 illustrates a guide groove provided in a first discharging mechanism of the card connector unit.
Figure 5:
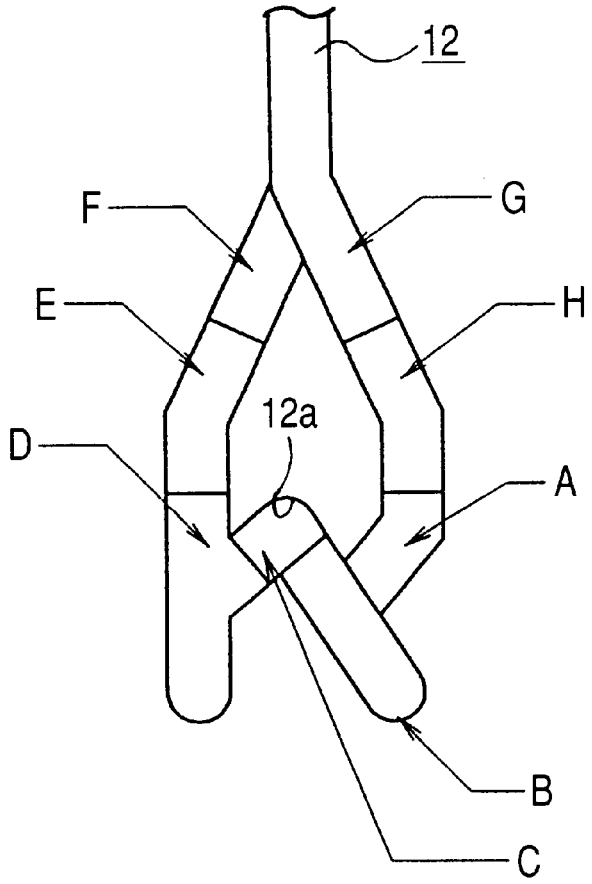
FIG. 5 illustrates a guide groove provided in a second discharging mechanism of the card connector unit.
Figure 5:
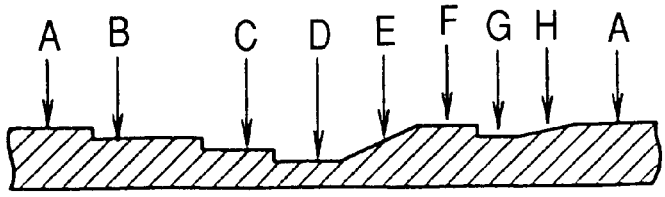

To describe a mode of carrying out the present invention with reference to accompanying drawings, FIG. 1 shows a plan of a card connector unit in the mode of carrying out the invention with the illustration of its cover dispensed with; FIG. 2 shows a plan of the housing of the card connector unit; FIG. 3, a plan of the terminal section of the card connector unit; FIG. 4 illustrates a guide groove provided in a first discharging mechanism of the card connector unit; and FIG. 5, a guide groove provided in a second discharging mechanism of the card connector unit.

The card connector unit illustrated in these drawings is intended for accommodating an SD card into the electronic device such as a PC which it is built into. A group of external connection terminals of an SD card placed in a prescribed position can be connected to an electronic circuit provided in an electronic apparatus per se. This card connector unit is configured to accommodate not only a shorter SD card but also a longer SD card.

To describe the specific configuration, this card Connector unit mainly consists of a housing composed by combining a frame 1 made of an insulating material and a cover (not shown) made of a metallic material, a plurality of metal sheet-made terminal units 2 constituted by linking terminal pieces 3 and 4 by a linking portion 5 and fixed to the frame 1 by an insert formation technique, a first discharging mechanism 6 provided on one side of the frame 1 and a second discharging mechanism 7 provided on the other side of the frame 1.

Between the frame 1 and the cover of the housing, there is formed an accommodating space 8 into which an SD card is to be inserted from the inlet 8*a* side. Also, as shown in FIG. 2, on one side of the frame 1 are formed guide grooves 9 constituting a part of the first discharging mechanism 6, a regulating wall 10 and a cutout 11, and on the other side of the frame 1 is formed a heart-shaped cam groove 12 constituting a part of the second discharging mechanism 7. Further, in the frame 1 is formed, near the inlet 8*a*, a peephole 13 through which ends of the terminal units 2 on one side are exposed.

The terminal units 2 are arranged in two rows, fore and rear, as shown in FIGS. 1 and 3. A group of terminal pieces 3 exposed near the central part of the accommodating space 8 constitute a first terminal section 30, and a group of terminal pieces 4 exposed in a deep part of the accommodating space 8 constitutes a second terminal section 40. Each pair of terminal pieces 3 and 4 of these first and second terminal sections 30 and 40 are arranged on the same straight line in the depthwise (lengthwise) direction of the frame 1, and linked by the linking portion 5 as described above. Further, the free ends of the terminal pieces 3 and 4 constitute contacts 3*a* and 4*a*, respectively, the relative positional relationship among the contacts 3*a* and that among the contacts 4*a* are all set to be equivalent to the relative positional relationship (terminal arrangement) among the grouped external connection terminals of the SD card. At the ends on one side of the terminal units 2 including the paired terminal pieces 3 and 4, there are provided soldering portions 2*a* as shown in FIG. 3, and the soldering portion 2*a* of each terminal unit 2 protrudes into the peephole 13 of the frame 1. These soldering portions 2*a* are soldered onto an electronic circuit provided on a circuit board (not shown) of the electronic apparatus per se.

Thus, in this card connector unit are set a first accommodating position in which the insertion depth of an SD card is smaller and a second accommodating position in which its insertion depth is greater. If the SD card is inserted to the vicinity of the central part of the accommodating space 8 and placed in the first accommodating position, its group of external connection terminals will come into contact with the Contacts 3*a* of the terminal piece 3. Or if the SD card is inserted as far as to a deep part of the accommodating space 8 and placed in the second accommodating position, its group of external connection terminals will come into contact with the contacts 4*a* of the terminal piece 4.

The first discharging-mechanism 6 is provided with a first sliding member 14 capable of reciprocating along the inserting/discharging direction of the SD card, an engaging arm 15 rotatably borne by this first sliding member 14 and capable of engaging with the fore edge of the SD card, a first engaging pin 16 moving along the guide groove 9 together with the shifting of the first sliding member 14, a keep plate 17 for keeping this engaging pin 16 from running off the groove 9, a first elastic piece 18 capable of engaging with a concave provided on one side edge of the SD card and held by the first sliding member 14, a second elastic piece 19 capable of engaging with the concave of the SD card and held by the engaging arm 15, and a first coil spring 20 for elastically energizing the first sliding member 14 in the discharging direction of the card. The regulating wall 10 and the cutout 11 of the frame 1 also are constituent elements of the first discharging mechanism 6. The regulating wall 10 regulates the outward rotation of the engaging arm 15 when the inserted position of the SD card has not yet reached the first accommodating position. On the other hand, the cutout 11, on the way of the SD card shifting from the first accommodating position toward the second accommodating position, permits the engaging arm 15 to rotate outward and sets aside the engaging arm 15.

The guide groove 9 is provided with a heart-shaped cam groove 21 having a pin engaging portion 21*a* for engaging the engaging pin 16 to keep the SD card in the first accommodating position, a first guide groove 22 continuous from the heart-shaped cam groove 21 upstream from the pin engaging portion 21*a* and extending inward, a second guide groove 23 continuous from the heart-shaped cam groove 21 downstream from the pin engaging portion 21*a* and extending inward, a return path for guiding the progress of the first engaging pin 16 in the process of the shifting of the SD card from the second accommodating position to the first accommodating position, and an extended path 25 continuous from the two guide grooves 21 and 22 and the return path 24 and extending inward. The second guide groove 23 constitutes a proceeding path to enable the SD card to shift from the first accommodating position to the second accommodating position. Within the return path 24 is formed a return pin engaging portion 24*a* for engaging the first engaging pin 16 on the way of shifting along this return path 24 and thereby to hold the SD card in the first accommodating position, and this return path 24 is made continuous to and from the second guide groove 23 downstream from the return pin engaging portion 24*a*. When the first engaging pin 16 is engaged by either the pin engaging portion 21*a* or the return pin engaging portion 24*a*, as the shifting of the first sliding member 14 is thereby inhibited, the SD card engaged with the first sliding member 14 via the first elastic piece 18 is held in the first accommodating position.

The second discharging mechanism 7 is provided with a second sliding member 26 having an engaging portion 26*a* projecting from it and capable of being engaged with the fore edge of the SD card, the sliding member 26 being capable of shifting reciprocatively along the inserting/discharging direction of the SD card, a second engaging pin 27 shifting along the heart-shaped cam groove 12 together with the shifting of this sliding member 26, a keep plate 28 for keeping this engaging pin 27 from running off the heart-shaped cam groove 12, and a second coil spring 29 for elastically energizing the second sliding member 26 in the discharging direction of the SD card. In the heart-shaped cam groove 12 is formed a pin engaging portion 12*a*. When the SD card is in the second accommodating position, the second engaging pin 27 is engaged by the pin engaging portion 12*a* to obstruct the second sliding member 26 from shifting. At this time, the second elastic piece 19 held by the engaging arm 15 is engaged with the recess of the SD card to hold the SD card in the second accommodating position.

Next will be described with reference to FIG. 6 through FIG. 17 the operation of the card connector unit configured as described above. First will be described its actions when a longer SD card 60 than the currently more common shorter SD card 50 is to be used with reference to FIG. 6 through FIG. 15.

Toward the fore edge of the longer SD card 60 in the inserting direction, there are provided a group of external connection terminals 61 that can come into contact with the contacts 3*a* and 4*a* of the terminal pieces 3 and 4, respectively. On one side edge of this SD card 60 is provided a recess 62 that can engage with the elastic pieces 18 and 19 of the first discharging mechanism 6. This longer SD card 60 is designed to be equal to the shorter SD card 50 in all respects including the width, the arrangement of the group of external connection terminals 61 and the distance from the fore edge to the recess 62 except that the longer SD card 60 has at its rear end an antenna circuit (not shown). It is desirable, when this antenna circuit is to be used, to place the card in the connector unit in a state in which the rear edge of the card is exposed outside the inlet.

Figure 6:
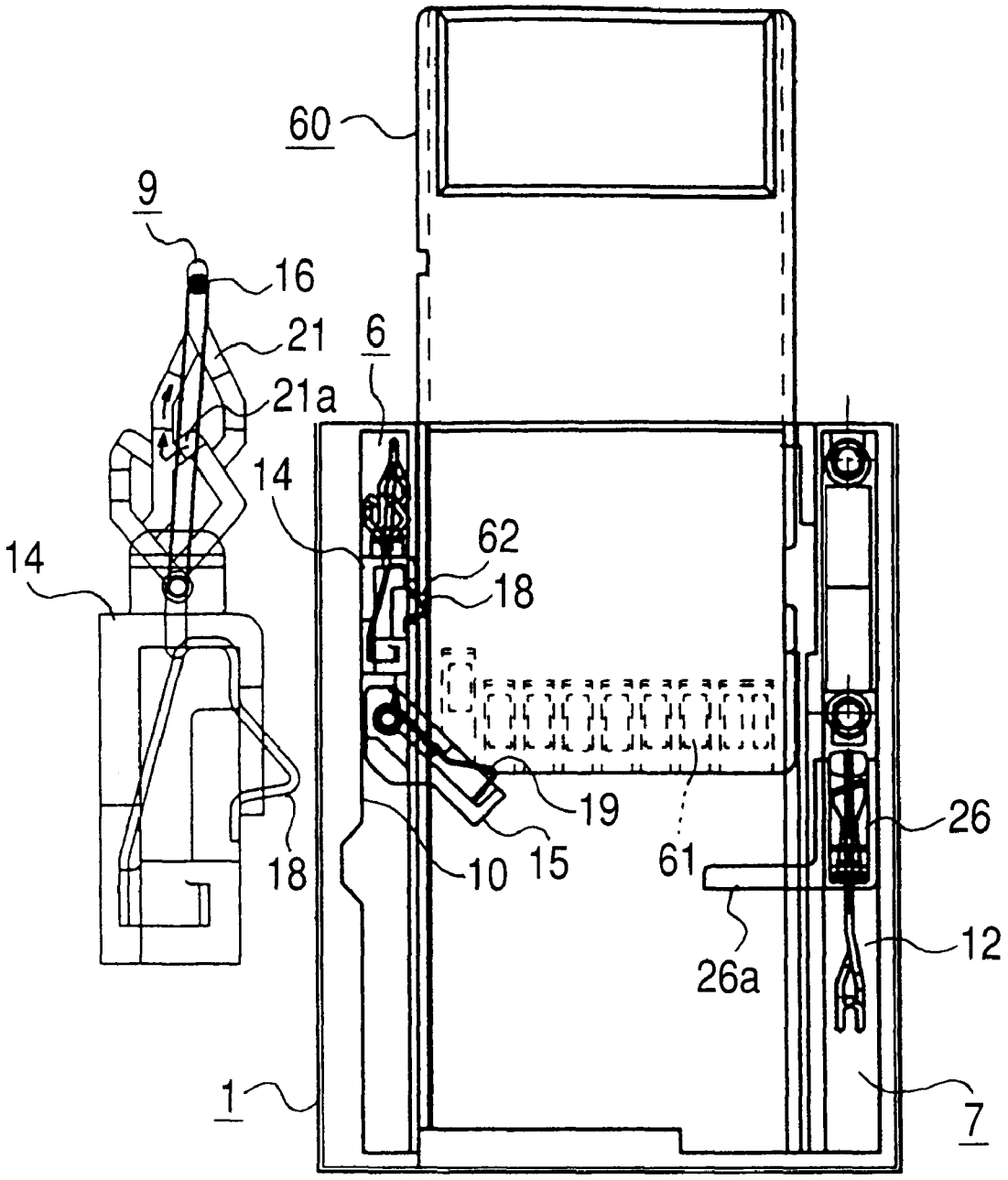
FIG. 6 illustrates the operation of the connector unit in which a longer SD card is inserted.

FIG. 6 shows a plan of the connector unit in this mode of carrying out the invention in a state immediately after the insertion of the longer SD card 60 is started. When the longer SD card 60 is inserted to the position shown in FIG. 6, the first elastic piece 18 engages with its recess 62, and the engaging arm 15 comes into contact with the fore edge of the SD card 60. Therefore, as the operator inserts the SD card 60 deeper, the engaging arm 15 whose outward rotation is regulated by the regulating wall 10 of the frame 1 is pressed inward by the SD card 60, the first sliding member 14 and the engaging arm 15 are shifted inward by the movement of the SD card 60 and, along with the shifting of the first sliding member 14, the first engaging pin 16 shifts along the heart-shaped cam groove 21.

Figure 7:
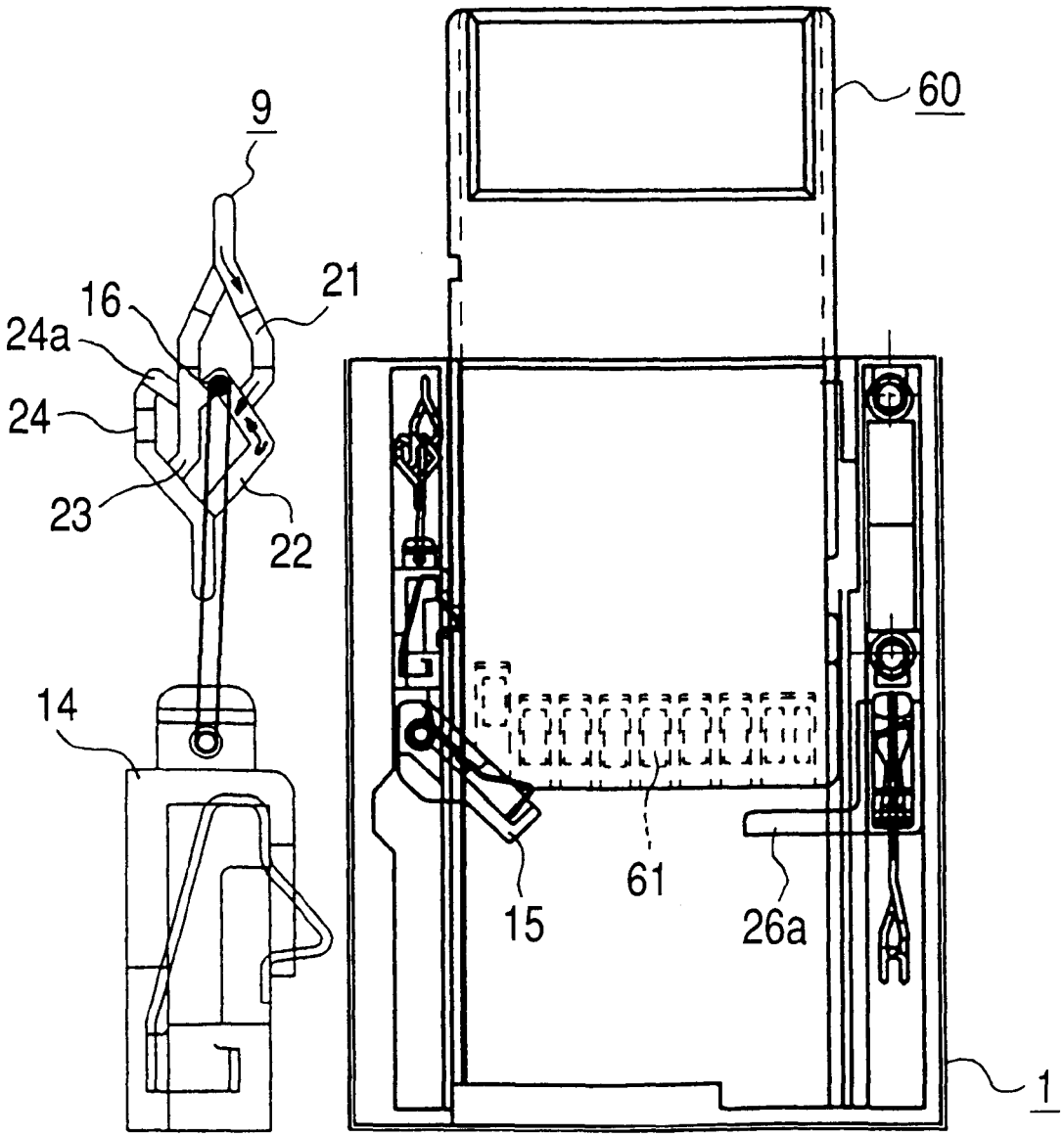
FIG. 7 illustrates the operation of the connector unit in which the longer SD card is inserted.
Figure 8:
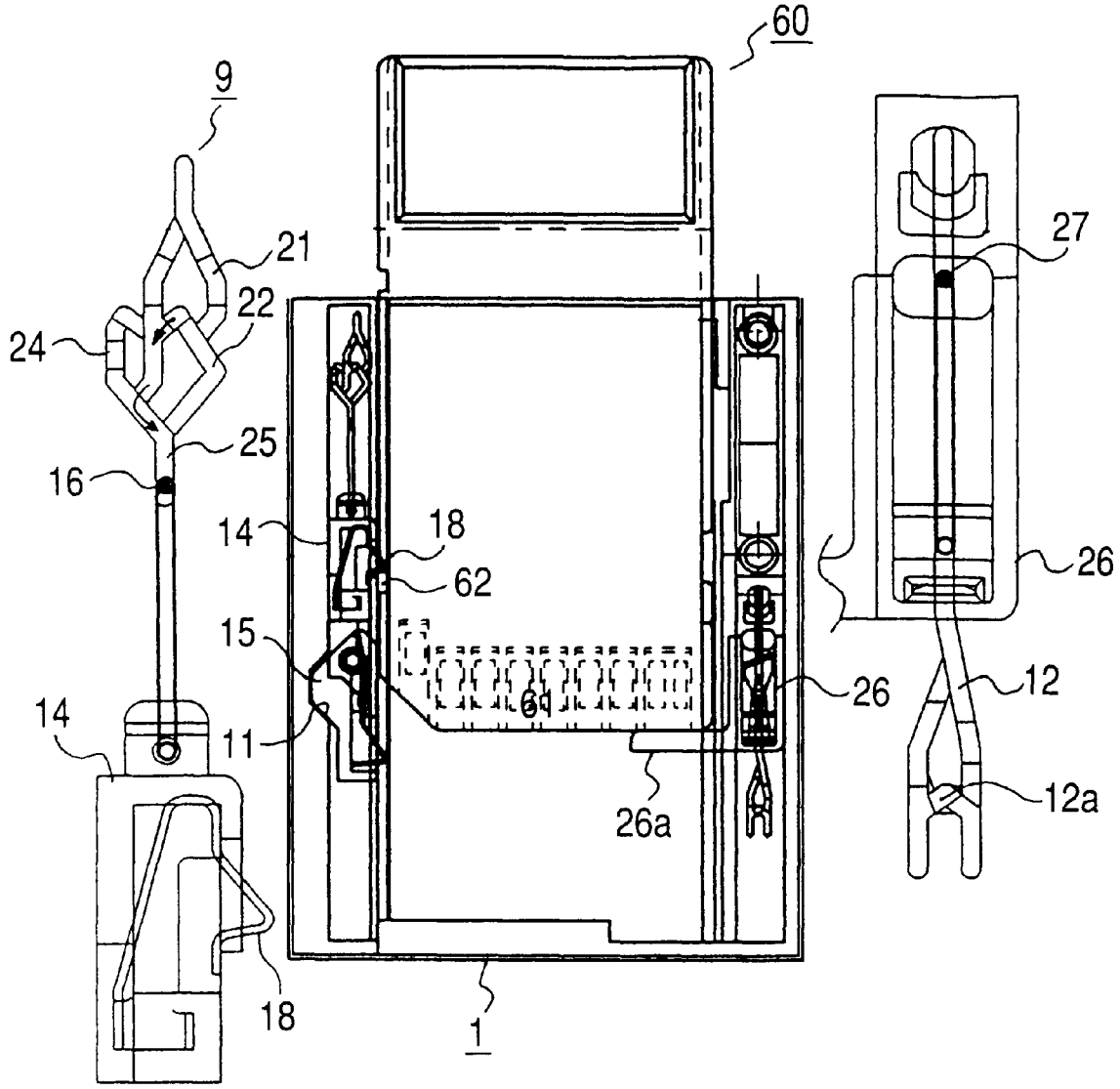
FIG. 8 illustrates the operation of the connector unit in which the longer SD card is inserted.

When the SD card 60 is pressed in somewhat deeper than its first accommodating position, the first engaging pin 16 shifts from the heart-shaped cam groove 21 to the first guide groove 22 as indicated by arrows in FIG. 7. Therefore, when the pressing force is removed, the elasticity of the first coil spring 20 presses outward the first sliding member 14 and the engaging arm 15 to enable the first engaging pin 16 to be engaged with the pin engaging portion 21*a*. Accordingly, the SD card 60 is held in its first accommodating position, in which the group of external connection terminals 61 are in contact with the contacts 3*a* of the terminal pieces 3, so that the antenna circuit exposed toward the operator is placed in a usable state.

When the SD card 60 thereby placed in its first accommodating position is to be discharged, the SD card 60 in the state shown in FIG. 7 can be pressed slightly inward. As this causes the first engaging pin 16 to be disengaged from the pin engaging portion 21*a* to shift downstream in the heart-shaped cam groove 21 as indicated by arrows in FIG. 6, the SD card 60 is pressed back to its discharging position by the first sliding member 14 and the engaging arm 15 which are shifted outward by the elasticity of the first coil spring 20. Thus, the operator can discharge the SD card 60 held in its first accommodating position by a simple one-push action.

Or when the SD card 60 held in its first accommodating position to use the antenna circuit is to be shifted to its second accommodating position, the operator can press inward the SD card 60 in the state of FIG. 7. Then, along with the shifting of the first sliding member 14, the first engaging pin 16 shifts from the heart-shaped cam groove 21 to the extended path 25 via the second guide groove 23 as indicated by arrows in FIG. 8. At the time when the SD card 60 has been inserted to the position shown in FIG. 8, the engaging arm 15, being pressed by the SD card 60, rotates outward to step aside into the cutout 11 of the frame 1, and accordingly the inward shifting of the engaging arm 15 is regulated. For this reason, even though the SD card 60 is pressed further inward, the first sliding member 14 remains unmoved, and the first elastic piece 18 is disengaged from the recess 62 of the SD card 60. However, as the fore edge of the SD card 60 is pressing inward the engaging portion 26*a* of the second sliding member 26 at this point of time, the second sliding member 26 follows the further inward shifting of the SD card 60, and the second engaging pin 27 shifts along the heart-shaped cam groove 12.

Figure 9:
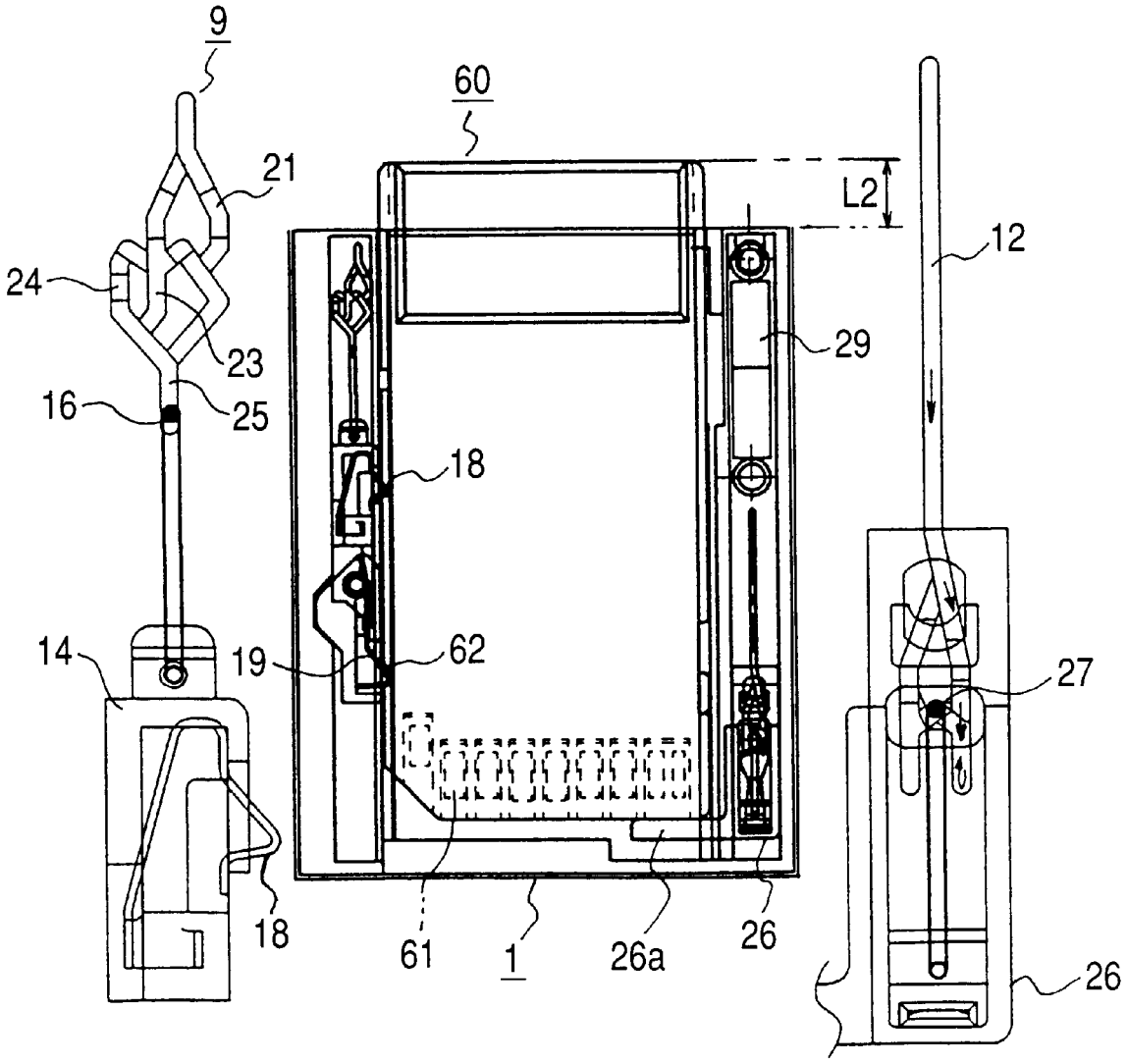
FIG. 9 illustrates the operation of the connector unit in which the longer SD card is inserted.
Figure 10:
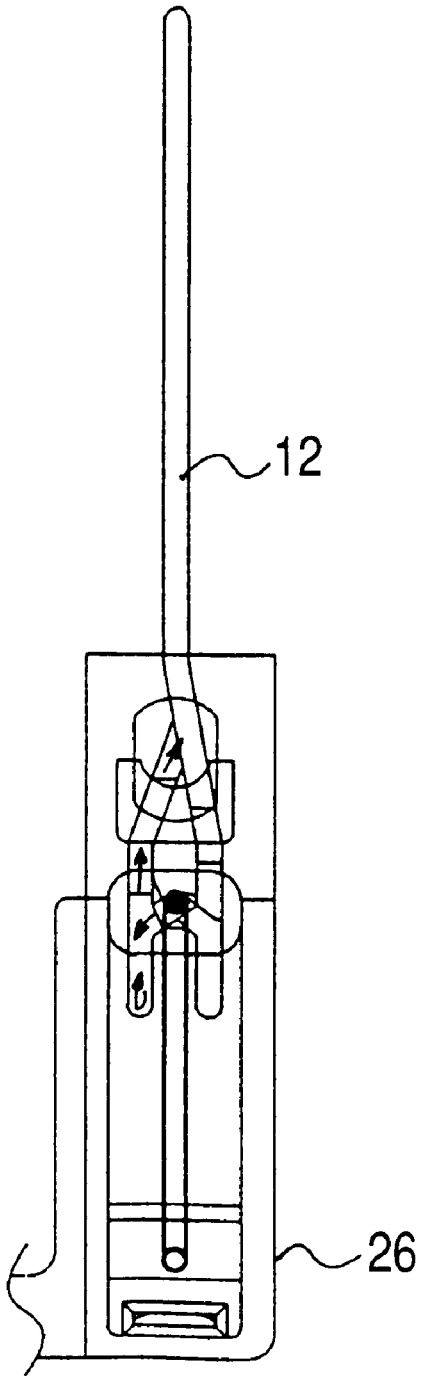
FIG. 10 illustrates the operation of the connector unit in which the longer SD card is inserted.

Then, by pressing the SD card 60 farther inward than its second accommodating position, the second engaging pin 27 shifts in the heart-shaped cam groove 12 as indicated by arrows in FIG. 9. Therefore, when the pressing force is removed, the elasticity of the second coil spring 29 presses outward the second sliding member 26 to enable the second engaging pin 27 to be engaged with the pin engaging portion 12*a*. Accordingly, the SD card 60 is kept in its second accommodating position in which the group of external connection terminals 61 are in contact with the contacts 4*a* of the terminal pieces 4, and is in a stowed state in which it does not protrude substantially outward. Incidentally, when the SD card 60 is placed in its second accommodating position, the second elastic piece 19 is in the recess 62 in the SD card 60 to be engaged with it.

Figure 11:
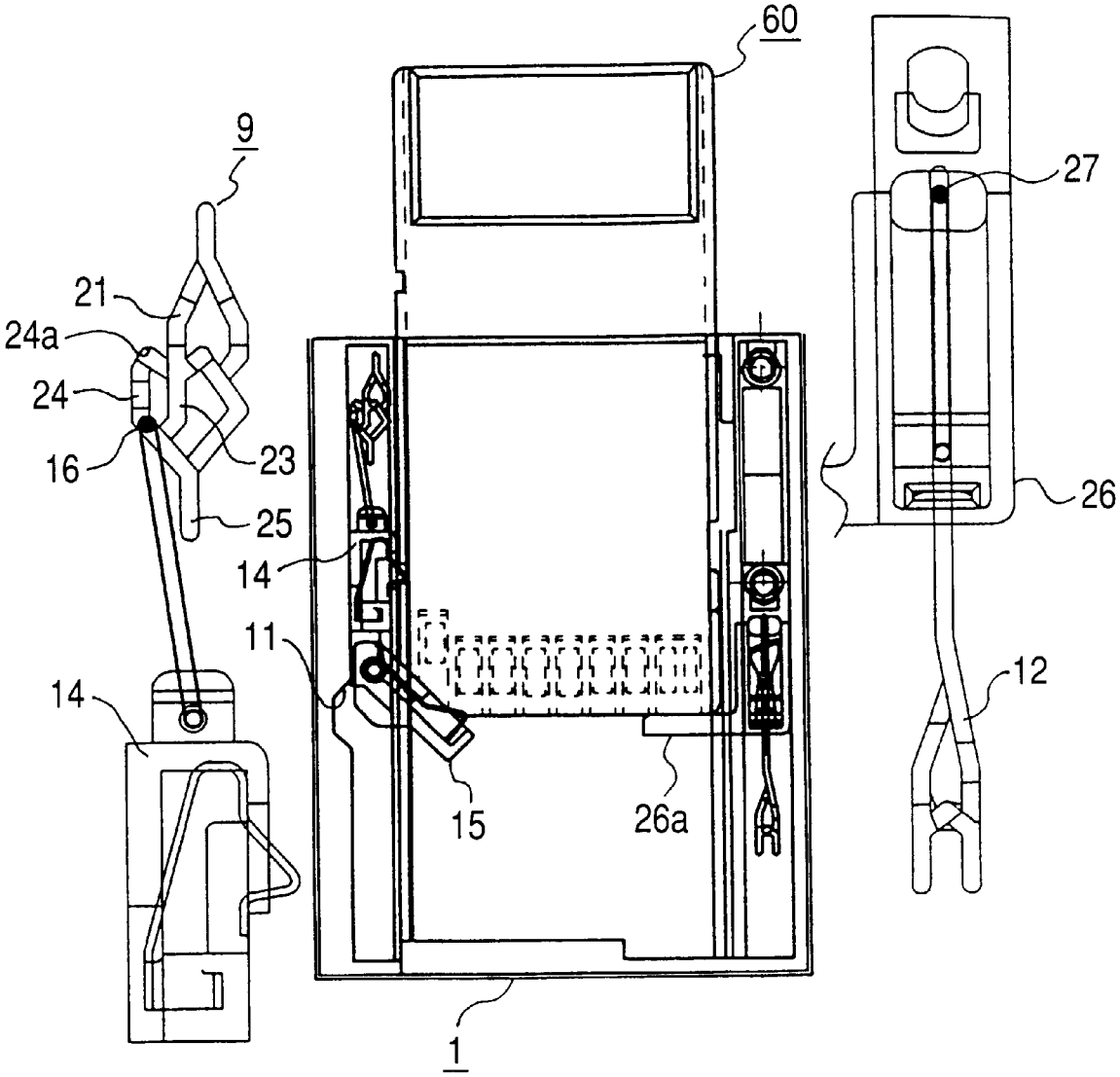
FIG. 11 illustrates the operation of the connector unit in which the longer SD card is inserted.
Figure 12:
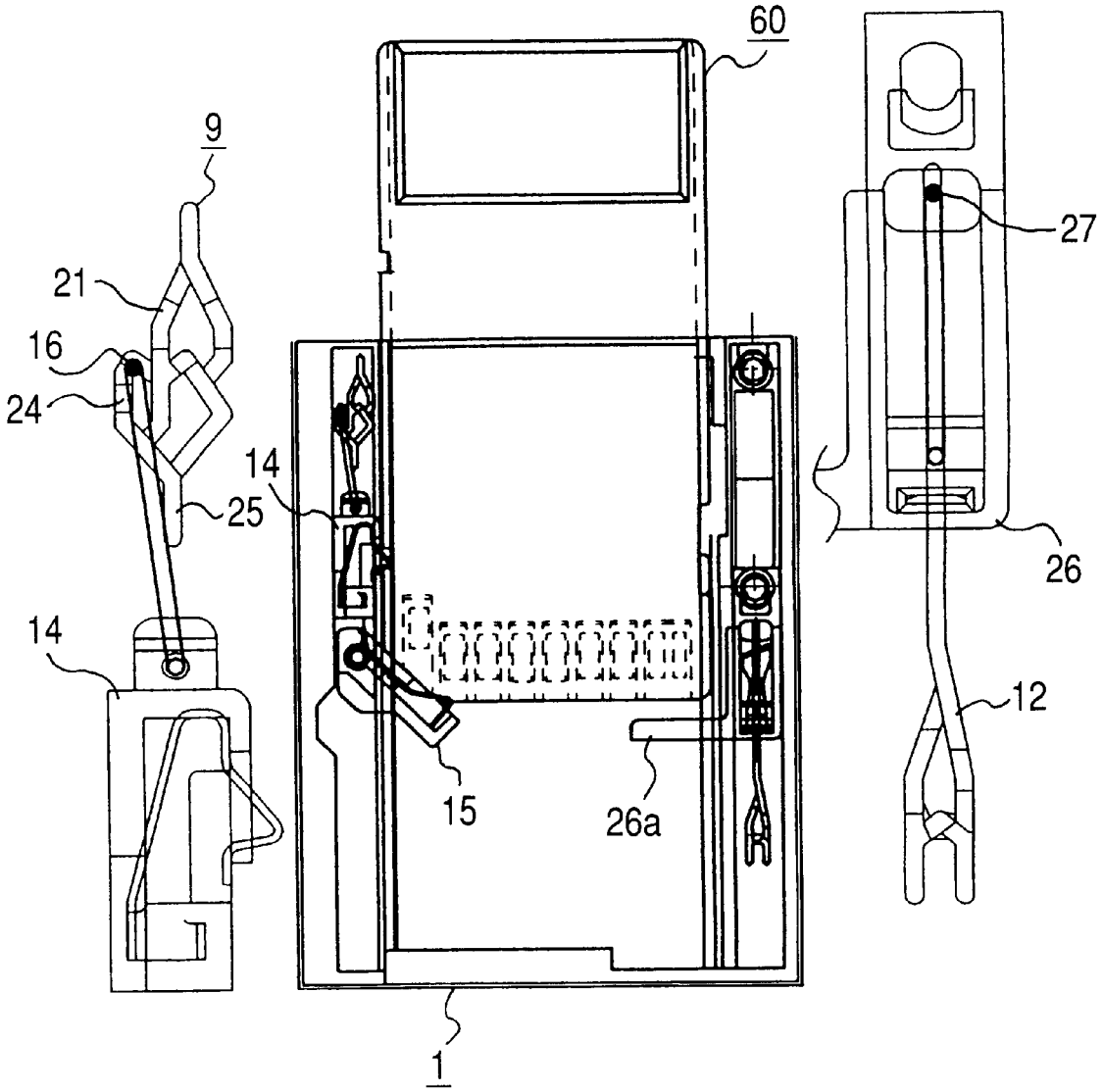
FIG. 12 illustrates the operation of the connector unit in which the longer SD card is inserted.

Or, when the SD card 60 held in its second accommodating position is to be shifted to the first accommodating position to use the antenna circuit, the SD card 60 in the state of FIG. 9 can be pressed further inward. As this causes the second engaging pin 27 to be disengaged from the pin engaging portion 12*a*, and shifts downstream in the heart-shaped cam groove 12 as indicated by arrows in FIG. 10, the SD card 60 is pressed back to its first accommodating position in the sequence shown in FIGS. 11 and 12 by the engaging portion 26*a* of the second sliding member 26 shifted outward by the elasticity of the second coil spring 29. FIG. 11 illustrates a state in which the engaging arm 15, until then kept aside in the cutout 11, rotates inward and the first sliding member 14 begins shifting outward, where the first engaging pin 16 is shifting from the extended path 25 to the return path 24. FIG. 12 shows a state in which the first engaging pin 16 is engaged by the return pin engaging portion 24*a* of the return path 24, and the SD card 60 has returned to its first accommodating position. Thus, the operator can shift the SD card 60, held in its second accommodating position, to the first accommodating position by a simple one-push action to set the antenna circuit in a usable state. However, as is evident from FIG. 7 through FIG. 12, the moving path of the first engaging pin 16 differs with the shifting direction of the SD card 60, i.e. whether it is shifting from the first accommodating position to the second accommodating position or vice versa.

Figure 13A:
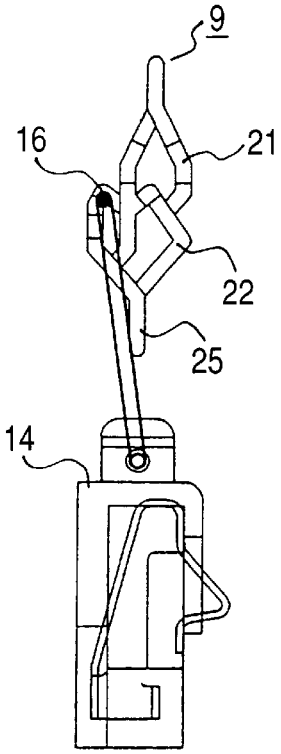
FIG. 13 illustrates the operation of the connector unit in which the longer SD card is inserted.
Figure 13B:
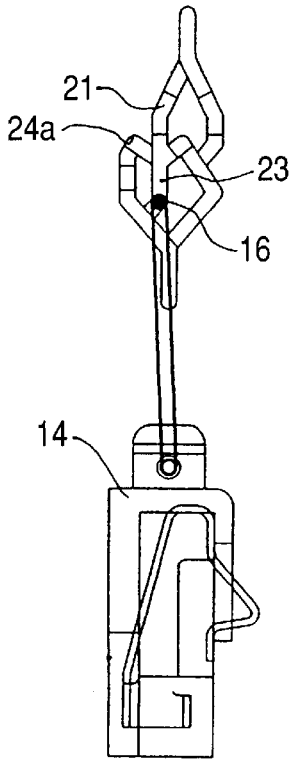
Figure 13C:
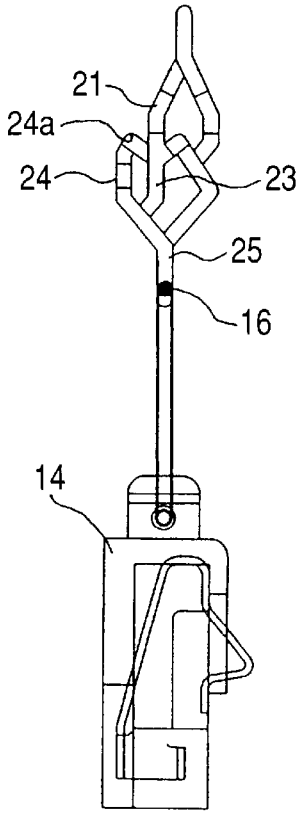
Figure 14A:
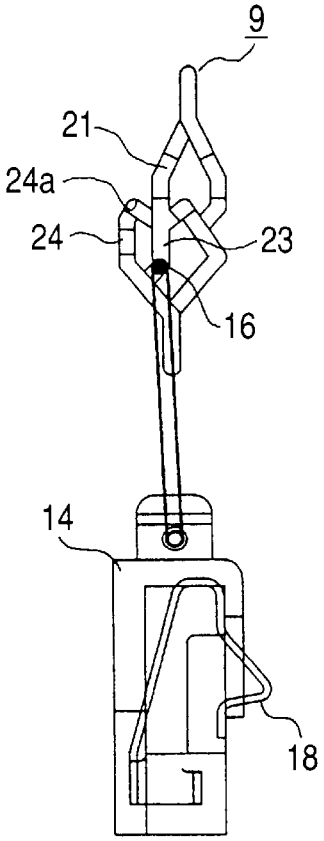
FIG. 14 illustrates the operation of the connector unit in which the longer SD card is inserted.
Figure 14B:
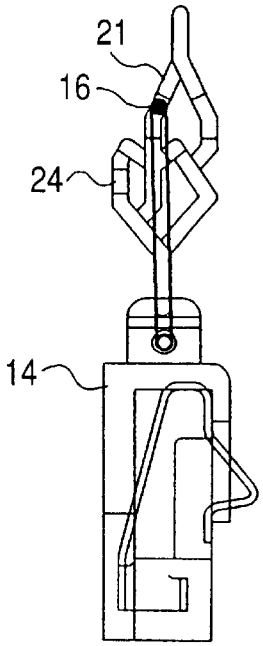
Figure 14C:
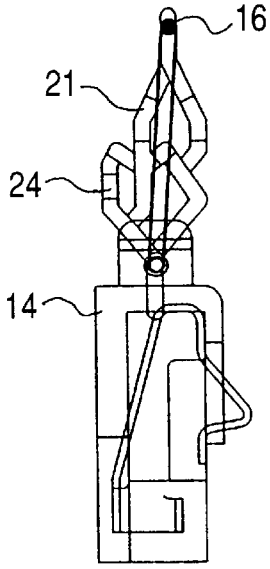
Figure 15:
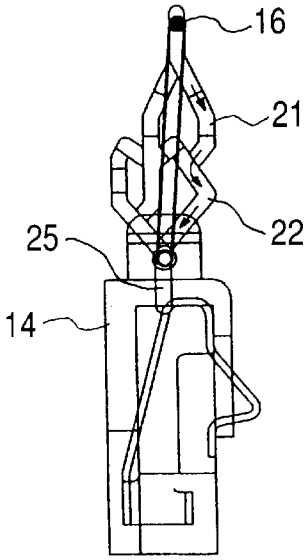
FIG. 15 illustrates the operation of the connector unit in which the longer SD card is inserted.

When the SD card 60, after it has thus been shifted from the second accommodating position to the first accommodating position to place the antenna circuit in a usable state, is to be shifted to the second accommodating position again, the operator has only to press the SD card 60 deeper inward. As this causes the first engaging pin 16 engaged with the return pin engaging portion 24*a* to shift along the second guide groove 23, which is its moving path, to the extended path 25 as shown in FIGS. 13A through 13C, continuing to press the SD card 60 inward will resulting in the state of FIG. 9 via the state of FIG. 8. When the SD card 60 having shifted from the second accommodating position to the first accommodating position to place the antenna circuit in a usable state is to be discharged, the operator can press the SD card 60 slightly inward and then remove the force acting on it. As this results in the pressing back, by the elasticity of the first coil spring 20, of the first sliding member 14 and the engaging arm 15 at the point of time when the first engaging pin 16 which has been engaged with the return pin engaging portion 24*a* has shifted midway along the second guide groove 23 as shown in FIGS. 14A through 14C, the first engaging pin 16 proceeds downstream in the heart-shaped cam groove 21 to discharge the SD card 60. To add, the part in which the first engaging pin 16 which has been engaged with the return pin engaging portion 24*a* is guided from the second guide groove 23 to downstream in the heart-shaped cam groove 21 in the process of shifting outward the SD card 60 from its first accommodating position constitutes the discharging path.

When it is desired to house the inserted SD card 60 immediately, the SD card 60 can as well be placed directly in the second accommodating position, the first accommodating position being skipped. Thus, as the inserted SD card 60 is pressed deep inward, the first engaging pin 16 shifts from the heart-shaped cam groove 21 to the extended path 25 via the first guide groove 22 as indicated by arrows in FIG. 15, continuing to press the SD card 60 inward will result in shifting to the state of FIG. 8 via that of FIG. 9.

Figure 16:
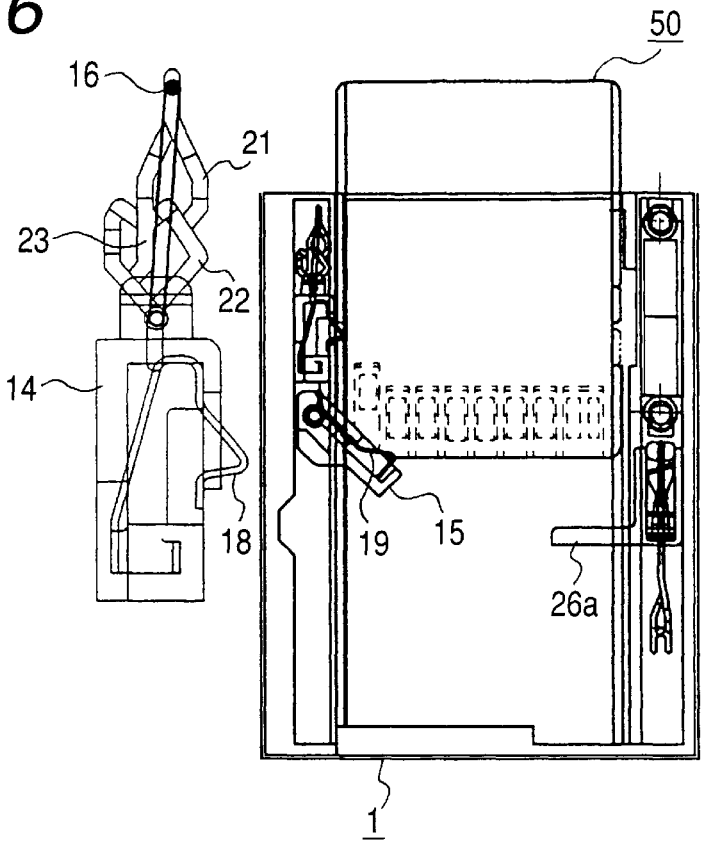
FIG. 16 illustrates the operation of the connector unit in which a shorter SD card is inserted.

Next, actions to use the shorter SD card 50 with this card connector unit will be described with reference to FIGS. 16 and 17. FIG. 16 shows a plan of the unit immediately after the insertion of the shorter SD card 50, and, FIG. 17, the plan of the unit in which the SD card 50 is placed in the first accommodating position.

As is evident from these drawings, the shorter SD card 50 cannot be inserted so far inside as to the second accommodating position, but can only be placed in the-first accommodating position. Further, as described above, the shorter SD card 50 and the longer SD card 60 are equal in the width, the arrangement of the group of external connection terminals and other respects. Therefore, exactly the same actions as described with reference to FIGS. 6 and 7 can be applied, i.e. the insertion of the longer SD card 60 into the first accommodating position and the discharging of the longer SD card 60. For instance, if the operator presses in the shorter SD card 50 in the state shown in FIG. 16, the first engaging pin 16 will shift to the first guide groove 22 through the heart-shaped cam groove 21 and, when the pressing force is removed, the SD card 50 can be placed in the first accommodating position because the engaging pin 16 then returns to the heart-shaped cam groove 21 to be engaged with the pin engaging portion 21*a*. Or if the operator presses in the SD card 50 slightly in the state of FIG. 17, as the first engaging pin 16 engaged with the pin engaging portion 21*a* will shift to the second guide groove 23, the engaging pin 16 will proceed downstream in the heart-shaped cam groove 21 to discharge the SD card 50 when the pressing force is removed.

Figure 17:
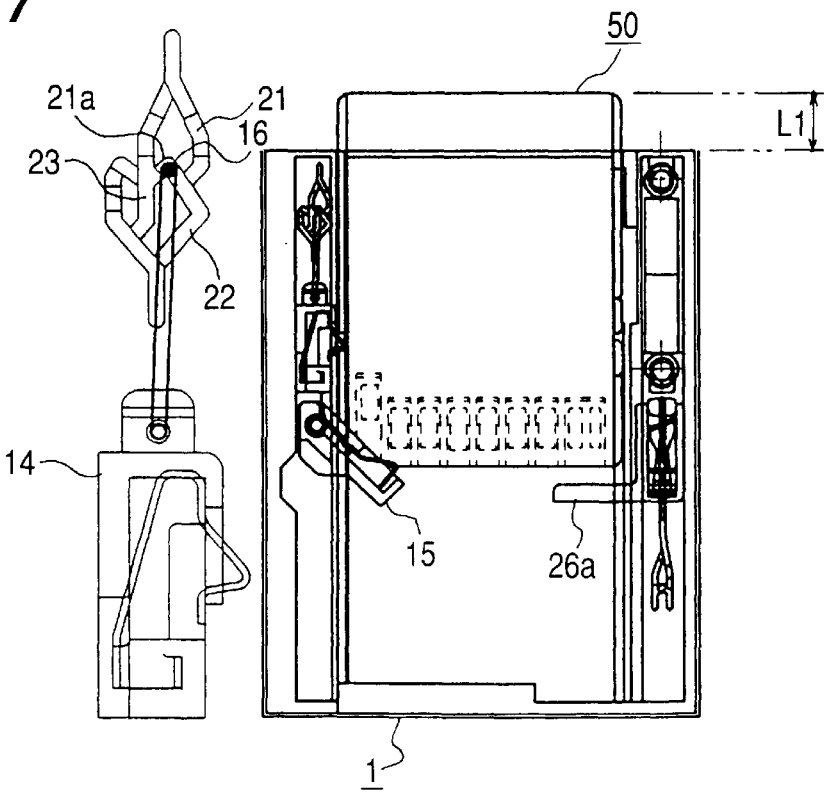
FIG. 17 illustrates the operation of the connector unit in which the shorter SD card is inserted.

To add, in this mode of implementing the invention, as shown in FIG. 17 and FIG. 9, these first and second accommodating positions are so set as to equalize the outward projecting length L1 of the rear edge of the shorter the SD card 50 placed in the first accommodating position and the outward projecting length L2 of the rear edge of the longer SD card 60 placed in the second accommodating position.

Thus in this mode of implementation, not only can the shorter the SD card 50 be used in the first accommodating position, but also can the longer SD card 60 be used in the second accommodating position. As even the longer SD card 60 can be stowed if it is placed in the second accommodating position, there is no fear of adversely affecting the appearance or the portability of the unit.

Also, as this mode of implementation allows the longer SD card 60 to easily and smoothly reciprocate between the first accommodating position and the second accommodating position by providing the first discharging mechanism 6, having the prescribed guide groove 9, that can discharge the SD card placed in the first accommodating position and the second discharging mechanism 7 that can shift the SD card placed in the second accommodating position toward the first accommodating position, it readily provides a practical way of use in which, for instance, the SD card 60 is placed in the first accommodating position only when the antenna circuit is to be used and is stowed in the second accommodating position at other times. Moreover, as there are provided the first coil spring 20 to give a discharging force to the SD card placed in the first accommodating position and the second coil spring 29 to give a discharging force to the SD card placed in the second accommodating position, it is possible to press in the SD card with a stable force all the time and thereby to extend the service lives of the coil springs.

Figure 18:
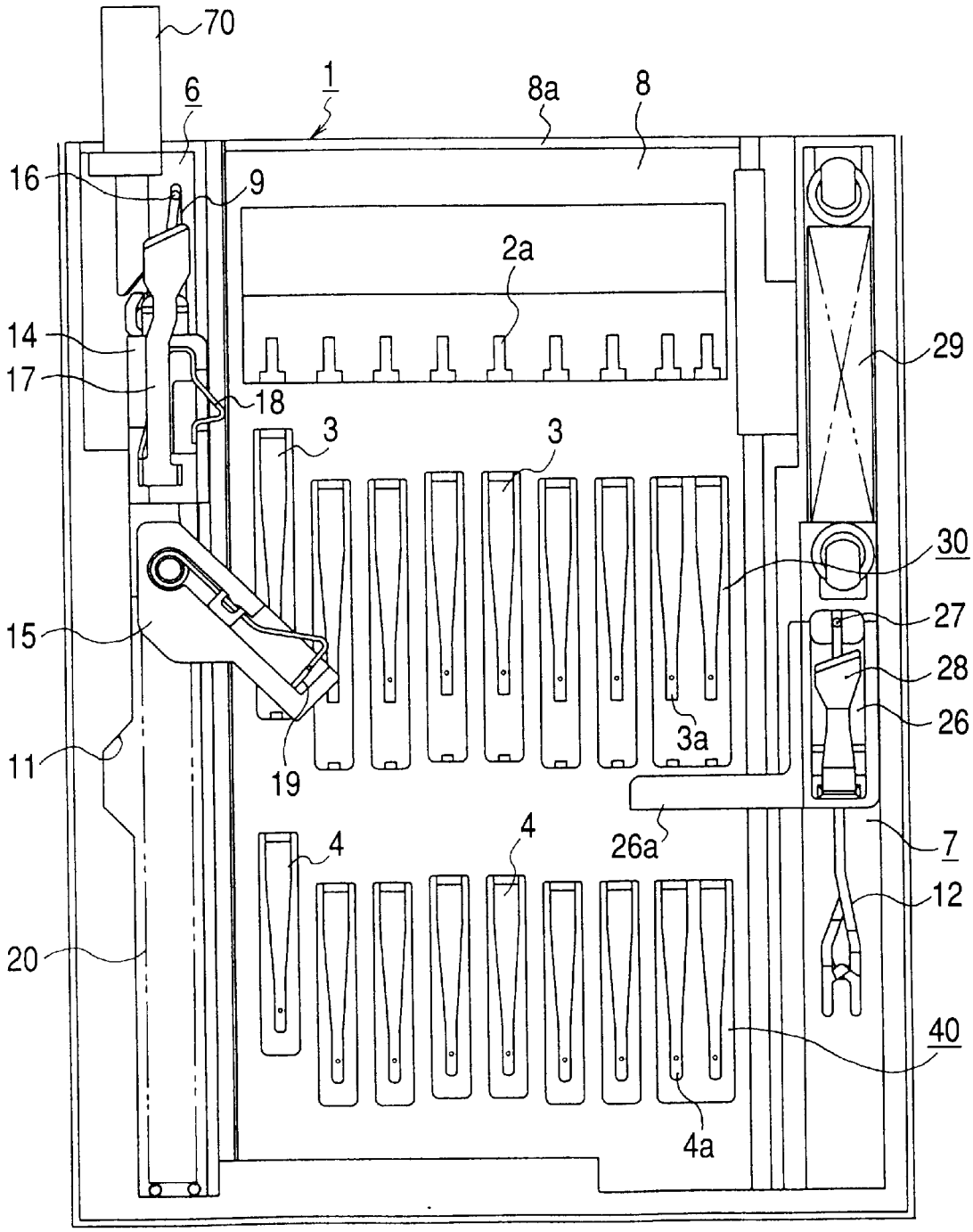
FIG. 18 shows a plan of a card connector unit in another mode of carrying out the present invention.

Another mode of implementing the present invention will now be described with reference to FIG. 18 through FIG. 20. The embodiment of the invention in this mode is designed to require the operator to press an operating member 70 for discharging use only when the longer SD card 60 having been shifted from the second accommodating position to the first accommodating position is to be discharged, and differs from the embodiment in the earlier described mode in the shape of the guide groove 9 for guiding the first engaging pin 16.

Thus, the guide groove 9 in this mode of implementation is provided with the heart-shaped cam groove 21 having the pin engaging portion 21 for engaging the first engaging pin 16 to hold the SD card in the first accommodating position, the guide groove 23 continuous to and from the heart-shaped cam groove 21 on the downstream side of the pin engaging portion 21, the return path 24 for guiding the direction of the first engaging pin 16 in the shifting process of the SD card from the second accommodating position to the first accommodating position, and the extended path 25 continuous to and from the guide groove 23 and the return path 24. Within the return path 24, there is formed the return pin engaging portion 24*a* for engaging the first engaging pin 16 shifting along this return path 24 to hold the SD card in the first accommodating position. However, unlike in the foregoing mode of implementation, the return path 24 and the guide groove 23 constitute no circulatory path, and the return path 24 also serves as a path for enabling the SD card to shift from the first accommodating position to the second accommodating position. Therefore, in order to shift the first engaging pin 16 from the return pin engaging portion 24*a* to the guide groove 23, the operating member 70 has to be manipulated to push up the engaging pin 16 to the guide groove 23.

Figure 19:
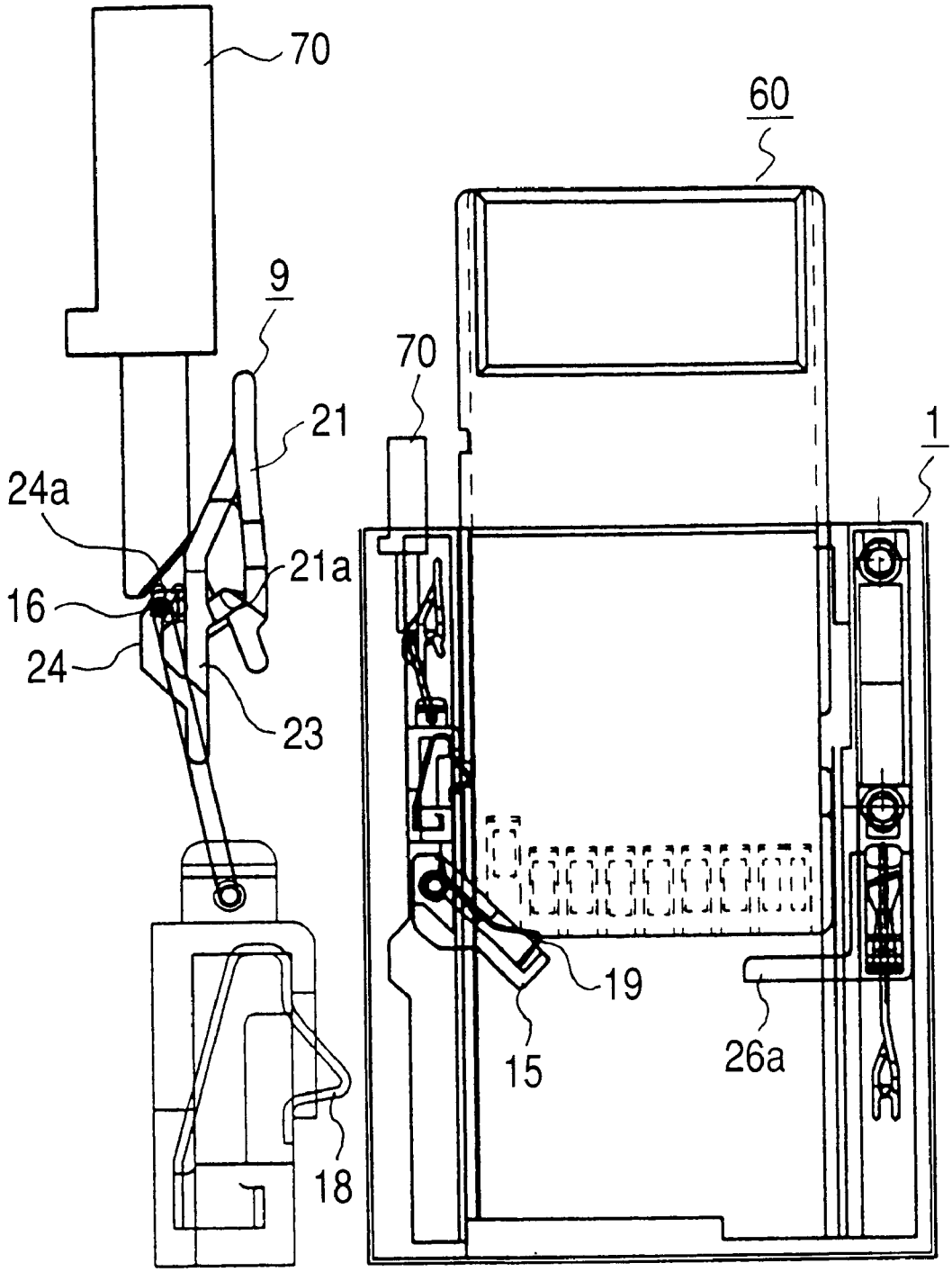
FIG. 19 illustrates the operation of the card connector unit.
Figure 20:
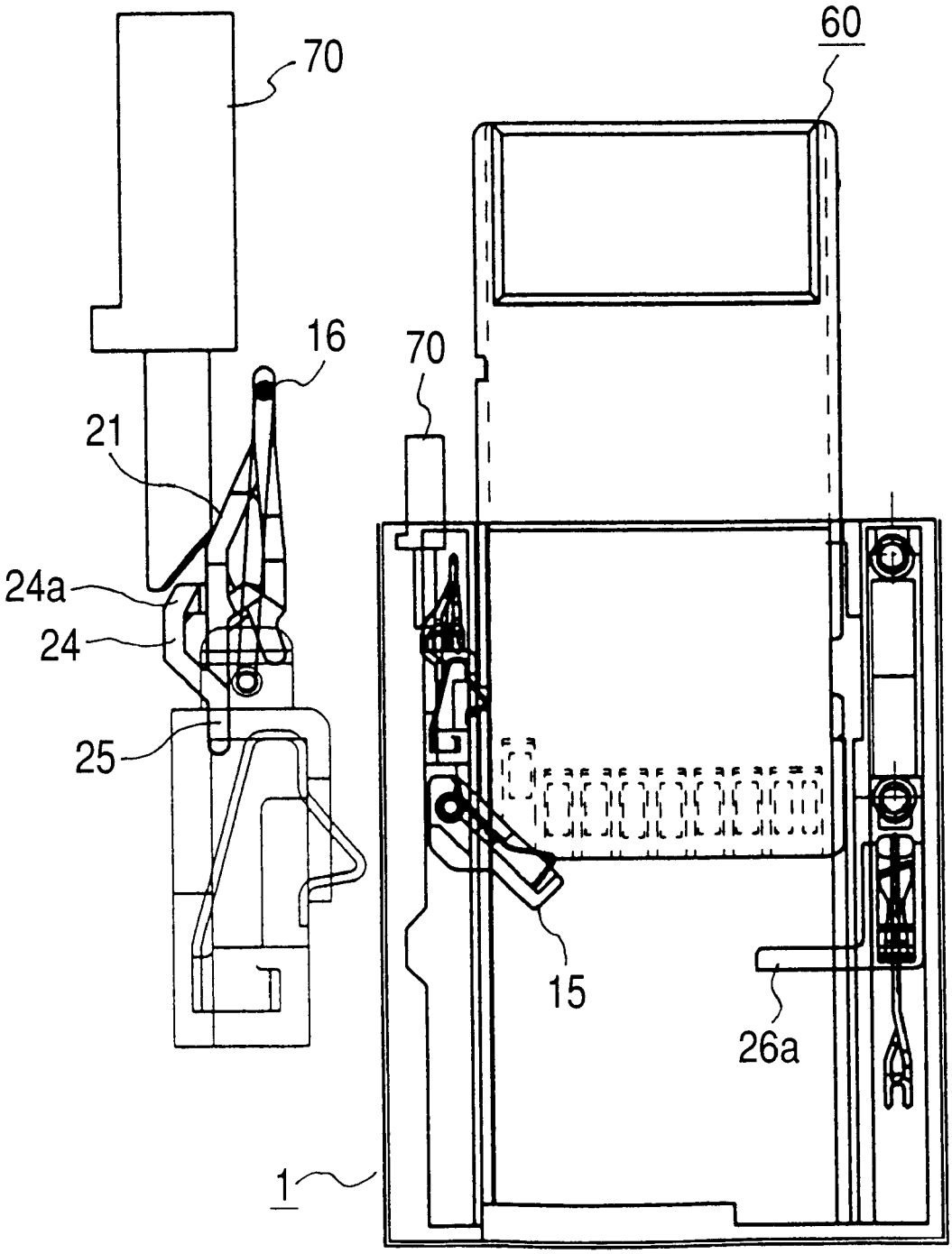
FIG. 20 illustrates the operation of the card connector unit.

FIG. 19 illustrates a state in which the longer SD card 60 having shifted from the second accommodating position is held in the first accommodating position. When the operator presses in the operating member 70 in this state, as the first engaging pin 16 engaged with the return pin engaging portion 24*a* is pushed up toward the guide groove 23, the engaging pin 16 proceeds downstream in the heart-shaped cam groove 21 to enable the SD card 60 to be discharged as illustrated in FIG. 20. However, if in the state of FIG. 19 the operator presses in the SD card 60, the first engaging pin 16 engaged with the return pin engaging portion 24*a* will proceed inward along the return path 24 only to reach the extended path 25, and therefore the SD card 60 cannot be discharged even though it can be placed in the second accommodating position Thus in this mode of implementation, the operating member 70 is used only when the longer SD card 60 is to be discharged, the SD card is directly pressed as in the foregoing mode of implementation when the accommodating position of the longer SD card 60 is to be altered or the shorter SD card 50 is to be inserted or discharged.

The present invention, implemented in the modes described above, provides the following advantages.

As the card connector unit permits not only a shorter SD card to be inserted and placed in the first accommodating position but also a longer SD card to be placed either in the first accommodating position or in the second accommodating position, it is possible, for instance, to insert the longer SD card deep inward and stow it in the second accommodating position when the unit is to be carried by the user, and to bring the SD card more outward with the shifting mechanism and to place it in the first accommodating position when the antenna circuit or the like is to be used, resulting in enhanced convenience of use.

If the shifting mechanism is provided with a sliding member, a heart-shaped cam groove, engaging pins, energizing members and the like, the longer SD card can be easily and smoothly shifted from one accommodating position to the other.

If there is provided a discharging mechanism that can discharge an SD card in the first accommodating position, there will be no need to use the elasticity of the energizing members of the shifting mechanism when the SD card in the second accommodating position is to be discharged, and therefore the energizing member, if it is a coil spring, can be extended in service life by restraining the extent of its extension and contraction. Nor will there be the phenomenon of an increase in reaction force with the elongation of the insertion depth, resulting in improved operating ease.

What is claimed is:

1. A card connector unit comprising:

a housing having an accommodating space into which a card provided with a group of external connection terminals is inserted from a side of an inlet, the accommodating space including a first accommodating position in which the insertion depth of the card in the accommodating space is smaller and a second accommodating position in which the insertion depth is greater;

a shifting mechanism for moving the card from the second accommodating position to the first accommodating position; and a plurality of terminal sections arranged side by side in the housing to correspond to the group of external connection terminals when the card is placed in the first accommodating position wherein, when the card is shifted from the second accommodating position accommodating to the first accommodating position, the card is brought into a useable state in which the group of external connection terminals are in contact with the plurality of terminal sections.

2. The card connector unit according to claim 1, whereof the shifting mechanism is provided with sliding members capable of reciprocating along an inserting/discharging direction of the card while being kept engaged with the card, engaging pins shifting along a heart-shaped cam groove along with shifting of the sliding members, and energizing members for elastically energizing the sliding members in a discharging direction of the card; wherein, when the card is placed in the second accommodating position, the engaging pins are engaged with pin engaging portions of the heart-shaped cam groove to inhibit shifting of the sliding members, and wherein, by pressing the card deeper in the accommodating space in such a state and thereby disengaging the engaging pins from the pin engaging portions, the card is shifted in the discharging direction from the second accommodating position via the sliding members.

3. The card connector unit according to claim 2, further comprising:

a discharging mechanism capable of discharging the card shifted from the second accommodating position to the first accommodating position by the shifting mechanism, the discharging mechanism including a first sliding member capable of reciprocating along the inserting/discharging direction of the card, an engaging arm to be engaged with the fore edge of the card, a first engaging pin shifting along a prescribed guide groove along with shifting of the first sliding member, and a first energizing member for elastically energizing the first sliding member in the card discharging direction.

4. The card connector unit according to claim 2, further comprising:

a discharging mechanism capable of discharging the card placed in the first accommodating position, the discharging mechanism including a first sliding member capable of reciprocating along the inserting/discharging direction of the card; an engaging arm rotatably pivoted on the first sliding member to be engaged with the fore edge of the card; a first engaging pin stifling along a prescribed guide groove along with shifting of the first sliding member, and a first energizing member for elastically energizing the first sliding member in the card discharging direction, a rotation regulator for regulating outward rotation of the engaging arm when an inserted position of the card has not reached the first accommodating position, and a rotation permitting section for permitting the outward rotation of the engaging arm and setting aside the engaging arm on the way of shifting of the card from the first accommodating position to the second accommodating position.

5. The card connector unit according to claim 4, wherein the guide groove is provided with a return path for guiding the first engaging pin in a process of shifting the card from the second accommodating position to the first accommodating position, a return pin engaging portion capable of holding the card in the first accommodating position by engaging the first engaging pin having passed the return path, and a proceeding path extending inward from the return pin engaging portion to enable the card to shift from the first accommodating position to the second accommodating position.

6. The card connector unit according to claim 5, wherein the guide groove is provided with a discharging path for guiding the first engaging pin in a process of shifting the card outward from the first accommodating position and an operating member for discharging the card placed in the first accommodating position, and wherein the first engaging pin can be shifted from the return pin engaging portion to the discharging path by manipulating the operating member to press in the first engaging pin.

* * * * *

UNITED STATES PATENT AND TRADEMARK OFFICE

CERTIFICATE OF CORRECTION

PATENT NO. : 6,669,493 B2
DATED : December 30, 2003
INVENTOR(S) : Yoshimasa Kuroda It is certified that error appears in the above-identified patent and that said Letters Patent is hereby corrected as shown below:

Column 12,
Line 63, change "stifling" to -- shifting --

Signed and Sealed this

Nineteenth Day of October, 2004

JON W. DUDAS
*Director of the United States Patent and Trademark Office*